United States Patent [19]

Carter

[11] 4,052,050

[45] Oct. 4, 1977

[54] ROTARY VACUUM PICKER WITH MECHANICAL ASSIST

[75] Inventor: Sidney T. Carter, Shrewsbury, Mass.

[73] Assignee: A-T-O Inc., Cleveland, Ohio

[21] Appl. No.: 660,066

[22] Filed: Feb. 23, 1976

[51] Int. Cl.[2] ..... B65C 9/14; B65H 3/10; B65H 3/22

[52] U.S. Cl. ..... 271/18.3; 271/22; 271/95; 271/106; 271/276; 156/568; 156/571; 156/DIG. 31

[58] Field of Search ..... 156/568–571, 156/447, 521, 519, DIG. 29, DIG. 31, 446, 566; 271/93, 95, 106, 112, 276, 33, 10, 11, 113, 18.3, 22

[56] References Cited

U.S. PATENT DOCUMENTS

| | | | |
|---|---|---|---|
| 1,536,670 | 5/1925 | Grasberger et al. | 271/33 |
| 2,318,215 | 5/1943 | Gans | 156/571 |
| 3,243,329 | 3/1966 | Anderegg | 156/571 |
| 3,284,270 | 11/1966 | Noll et al. | 156/521 |
| 3,369,803 | 2/1968 | Walton et al. | 271/10 |
| 3,723,228 | 3/1973 | Schaltegger | 156/568 |
| 3,864,187 | 2/1975 | Carter | 156/571 X |

*Primary Examiner*—Charles E. Van Horn
*Assistant Examiner*—M. G. Wityshyn
*Attorney, Agent, or Firm*—Dike, Bronstein, Roberts, Cushman & Pfund

[57] ABSTRACT

A labeling machine of the kind wherein labels are removed one at a time from a stack of labels by a rotating picker provided with axially spaced annular picking surfaces disposed for rotation about an axis parallel to the endmost label in the stack at a distance therefrom such that the annular picking surfaces of the picker are tangent to the plane of the endmost label. The annular picking surfaces contain diametrically disposed slots which are connected to a vacuum as they are moved into engagement with the endmost label and thereafter at a predetermined place in the further rotation of the picker are disconnected to release the label characterized in that there is a needle fixed in each slot with its pointed end flush with the annular picking surface of the picker and with which the portion of the label crossing the slot is held engaged during the period the picker is taking hold of the label and releasing it.

1 Claim, 18 Drawing Figures

ROTARY VACUUM PICKER WITH MECHANICAL ASSIST

BACKGROUND OF INVENTION

Rotary vacuum pickers such as shown in U.S. Pat. Nos. 3,806,114 and 3,864,187 are currently in use for removing labels one at a time from a stack of labels and for the most part will hold the label while withdrawing it from the stack particularly if the labels are soft and/or unsized sometimes, however, labels are made of a stiff paper and/or the paper of the label whether soft or stiff may require sizing to protect them from being discolored by overflow of the contents of the container as, for example, a detergent and will slip relative to the surface of the picker because the edges of the vacuum slot do not dig into the hard and/or smooth slippery surfaces of the labels. At other times a slight loss of vacuum especially when the picking is marginal because of the stiffness and/or smoothness of the paper results in slipping. It is also known to employ mechanical means in the form of pins to pick labels from a stack, however, such apparatus depends for its operation on penetration of the pins into the labels and this is undesirable. It is the purpose of this invention to provide the advantages of vacuum picking and mechanical picking in such a way as to prevent slipping of labels which have hard and/or slippery surfaces and to compensate for slight losses in vacuum during picking which may result in slippage without the disadvantage of penetration or otherwise defacing the labels.

SUMMARY OF INVENTION

As herein illustrated the apparatus of this invention is for removing labels from a stack of labels and comprises a rotary picker provided with a plurality of axially spaced annular surfaces, supported for rotation about an axis parallel to the plane of the endmost label of a stack of labels and at such a distance therefrom that the annular surfaces have tangential engagement with the endmost label. The annular surfaces contain diametrically arranged slots. There is means for rotating the picker to periodically bring the slots into engagement with the endmost label, means for connecting the slots to a vacuum as they approach the place of tangency to take hold of a label and at a predetermined time thereafter disconnect them so as to release the label and means within the slots with which the label is drawn into engagement by the vacuum to frictionally resist movement of the label relative to the annular surfaces of the picker. The picker is supported at one end of the endmost label in the magazine for taking hold of the endmost label at the place of tangency therewith and is rotated in a direction so that at the place of tangency with the label the annular surfaces of the picker are moving toward the opposite end of the label. The means within the slots for engagement with the label drawn across the slots by the vacuum are needles set into the slots with their points flush with the annular surfaces of the picker. There are two rows of three axially spaced vacuum slots arranged peripherally of the picker which are axially elongate, each of which contains a needle. Each elongate slot is connected midway between its ends to a vacuum passage and the needle is fixed within the slot between one end and the vacuum passage.

The invention will now be described in greater detail with reference to the accompanying drawings, wherein:

FIGS. 1 to 14 inclusive, are plan views of a rotary picker diagrammatically illustrating the removal of the successive labels from a magazine of labels and presenting them to a turret for application of adhesive thereto prior to pressing the labels into engagement with the containers showing the vacuum openings and picker needles;

Figure 1:
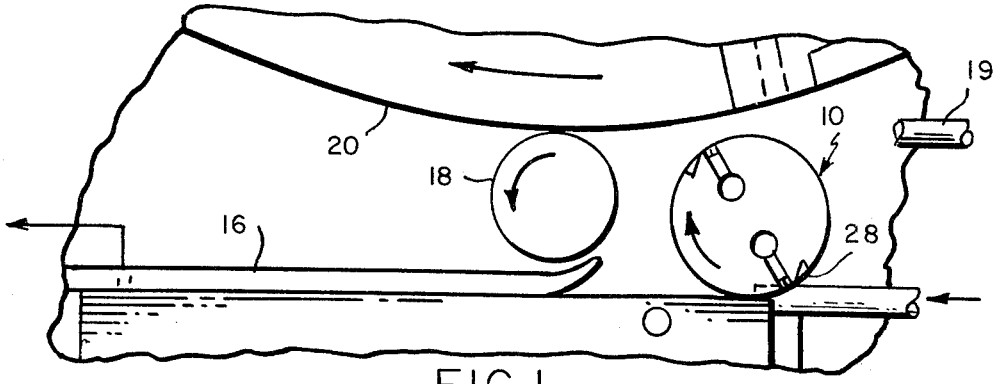
Figure 2:
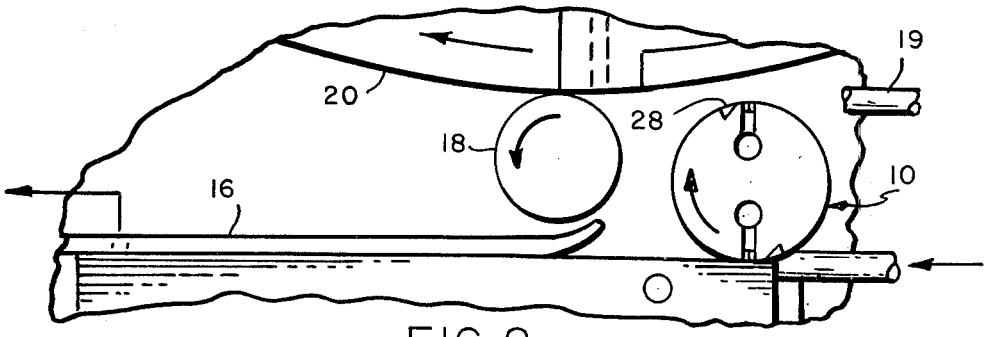
Figure 3:
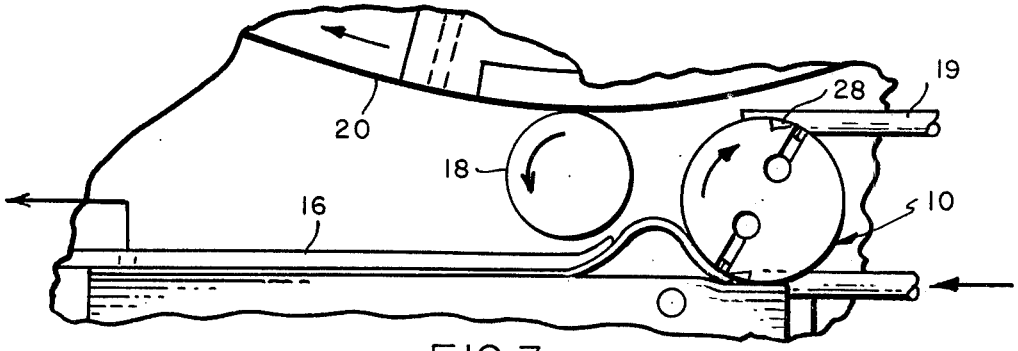
Figure 4:
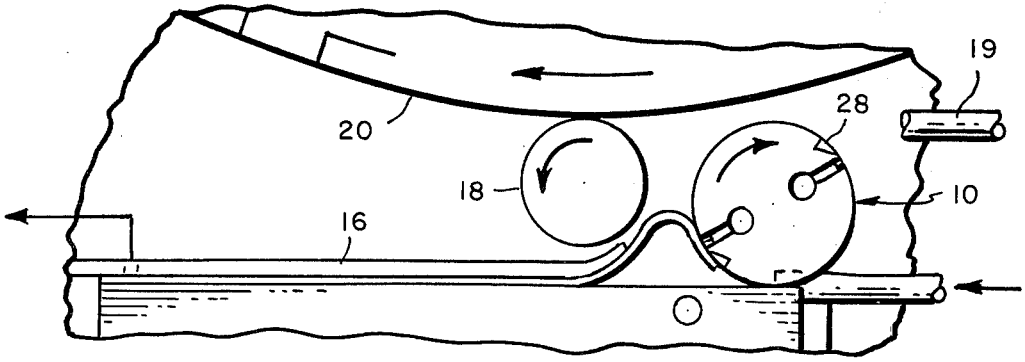
Figure 5:
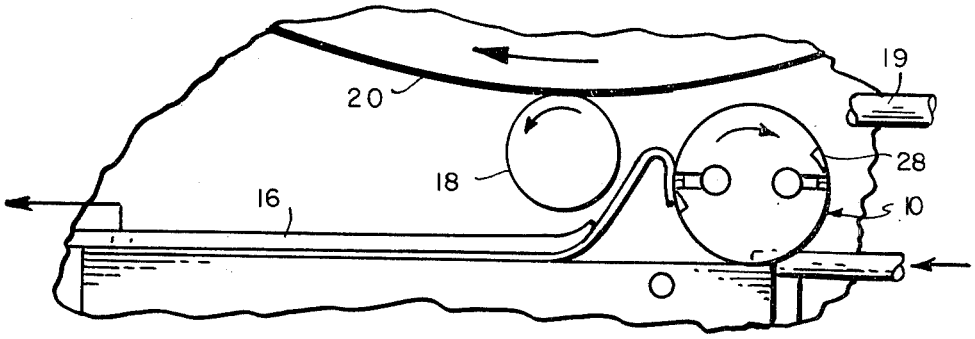
Figure 6:
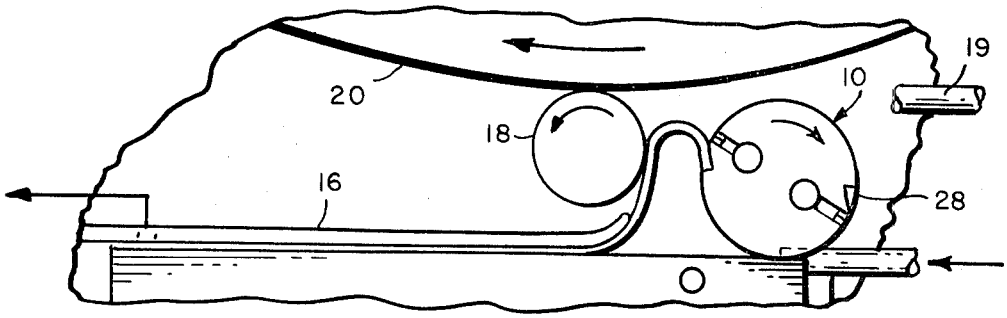
Figure 7:
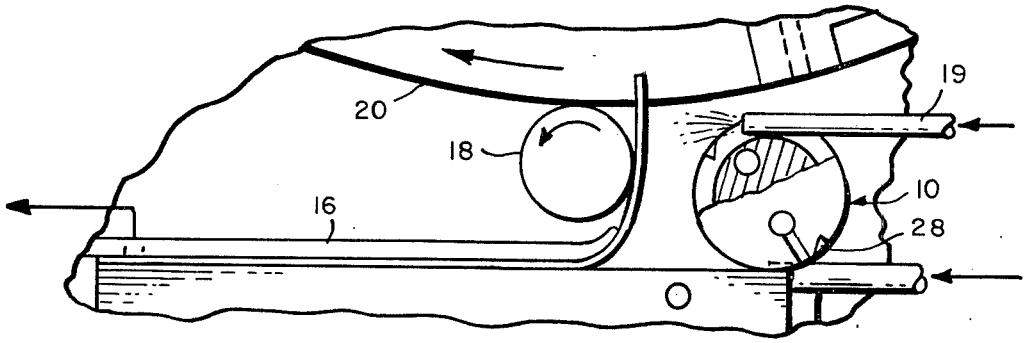
Figure 8:
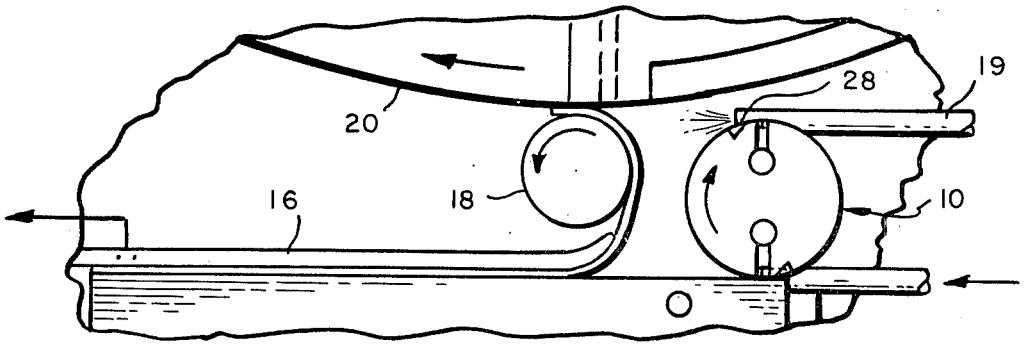
Figure 9:
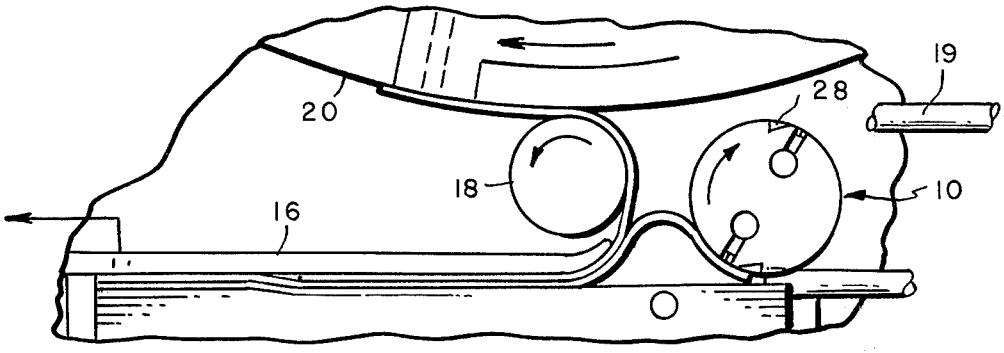
Figure 10:
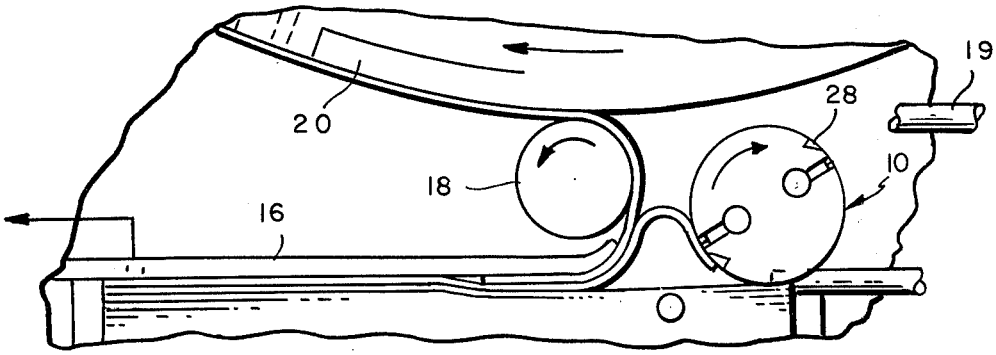
Figure 11:
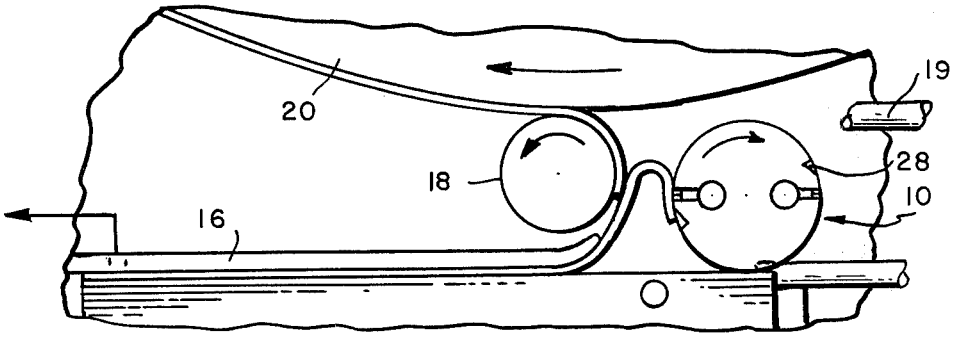
Figure 12:
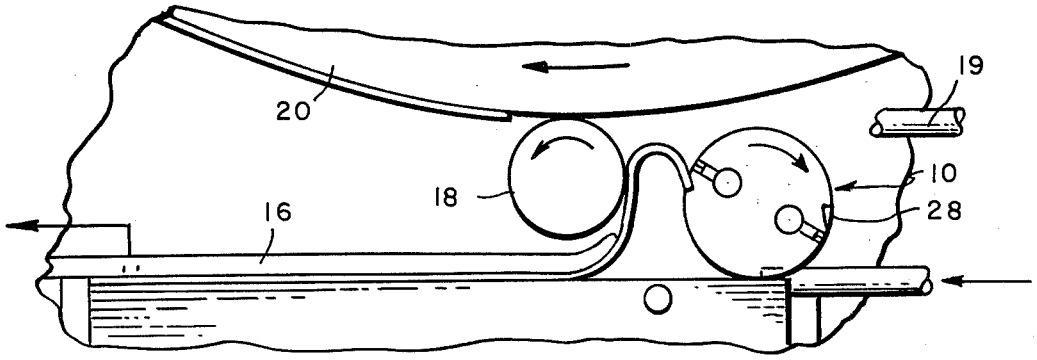
Figure 13:
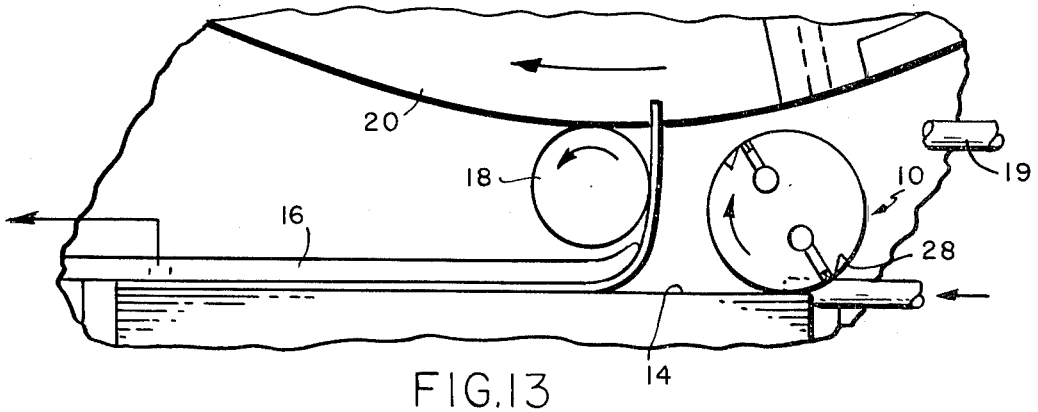
Figure 14:
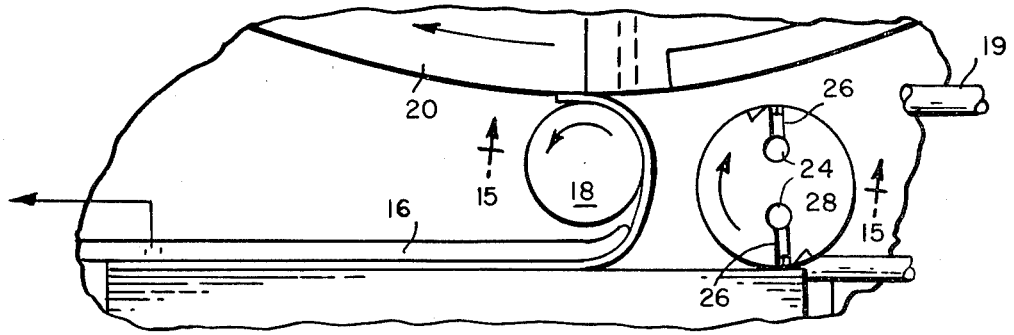

Referring to the drawings, FIGS. 1 to 15, the picker 10 is of the kind shown in the aforesaid patents embodying a plurality of axially spaced annular vacuum picking surfaces 12 and is supported for rotation about a vertical axis X—X parallel to the plane of the endmost label of a stack of labels supported within a magazine, a portion 16 of which is shown in FIGS. 1 to 14, with the annular vacuum picking surfaces tangent to the plane of the endmost label for vacuum picking the endmost label from the magazine and presenting its free end between a feed roll 18 and a turret 20 for delivery by the turret to an adhesive applicator for application thereto, not shown herein. The turret 20, like the picker, is rotatable about a vertical axis. The stack of labels is yieldably held against the portion 16 of the magazine so that only a portion of the endmost label is exposed, the remainder being frictionally held against the end portion 16 of the magazine.

Figure 15:
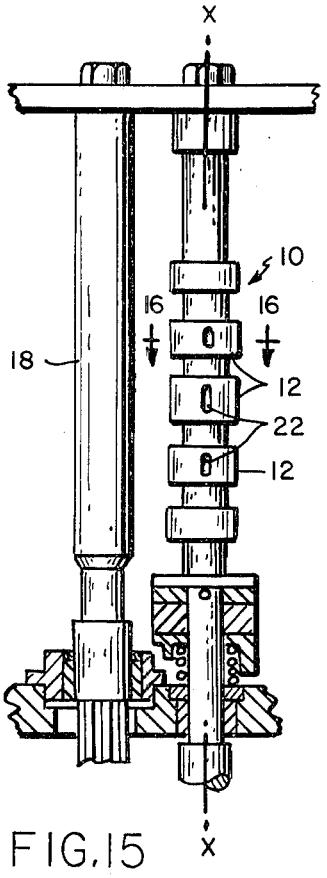
FIG. 15 is an elevation to much smaller scale of the rotary picker and a feed roll adjacent thereto which delivers the freed end of the label to the turret.
Figure 17:
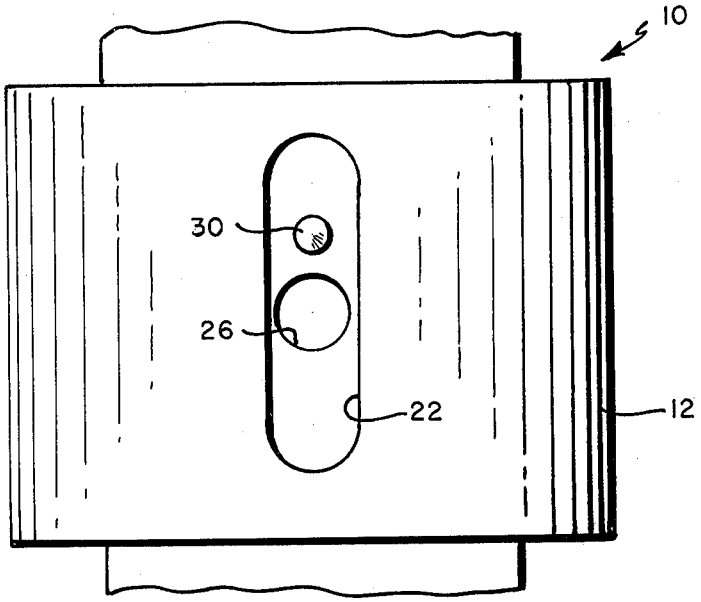
FIG. 17 is an elevation of a portion of the picker to the same size as FIG. 16 showing a single vacuum slot and the location of the needle therein.

As described in my U.S. Pat. Nos. 3,806,114 and 3,386,187 the annular surfaces of the picker 10 are provided with diametrically displaced slots 22—22, FIG. 17, which are axially elongate, as shown in FIGS. 15 and 17. Within the picker structure there are axially disposed passages 24 which are adapted to be connected to and disconnected from a vacuum source and these passages are connected by radial passages 26 to the slots 22 substantially midway between the opposite ends of the slots 22. As described in the aforesaid patents, the picker 10 is rotated at a predetermined rate in synchronism with the turret 20 to move the vacuum slots successively into engagement with the endmost labels, pick the ends from the stack and present them to the turret and this is accomplished by connecting the vacuum slots with the vacuum source at the moment or slightly before the slot moves into engagement with the endmost label and then disconnecting it from the vacuum when the picker has rotated in the direction of rotation to the position shown in FIG. 6 where the end has been moved beyond the center of rotation in the direction of rotation and when released straightens out and is displayed by a jet 19 into the bite between the feed roll 18 and the turret 20. As shown in the aforesaid patents a notch 28 may be provided directly to the rear of the opening 22 with respect to its direction of rotation to assist in moving the label with the picker. The provision of the notches is optional.

In most instances the apparatus shown in the aforesaid patents operates very satisfactorily to pick labels from a magazine and to present them to a turret for application of adhesive, the suction orifices and the notches operating to insure a good grip on the label so that it is pulled free of the magazine and carried around into the bite of the feed roll with the turret. This is especially true if the labels are comprised of a relatively soft unsized paper and the vacuum is operated efficiently because the vacuum will pull the labels across the vacuum slot sufficiently taut to cause the sharp edges of the vacuum slot to dig into the label and this develops some friction which assists the vacuum in preventing the labels from slipping relative to the picker. Some labels, however, are comprised of stiff paper which has smooth hard surfaces while others have to be coated with a size to protect them from discoloring, for example, from the spilled filling material. In such cases the edges of the slot do not dig into the labels sufficiently to prevent them from slipping and this is further aggravated if by chance the vacuum is not operating efficiently. Slippage of the labels relative to the picker, of course, upsets the labeling operation requiring the machine be stopped and the labels which have been only partly withdrawn or withdrawn but out of register with the turret be removed before the operation can be reinstated.

Figure 16:
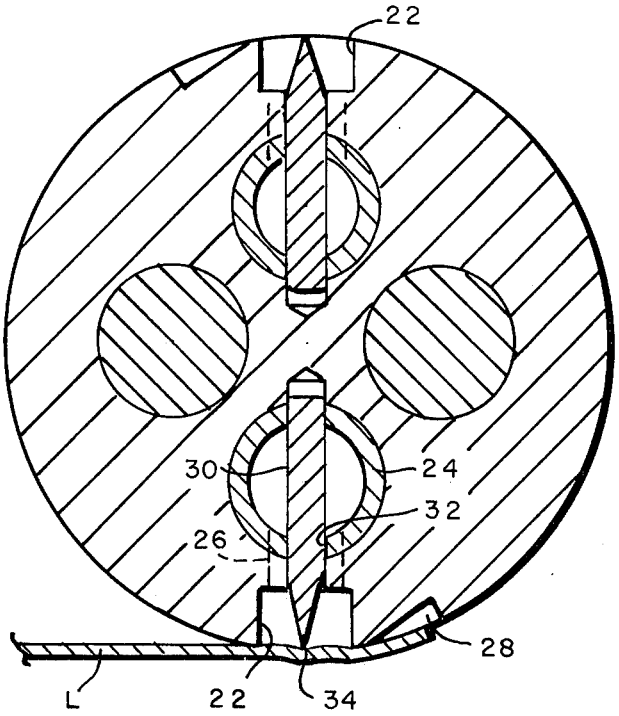
FIG. 16 is a very much enlarged section of the picker modified according to this invention taken on the line 16—16 of FIG. 15 showing needles set into the vacuum slots.
Figure 18:
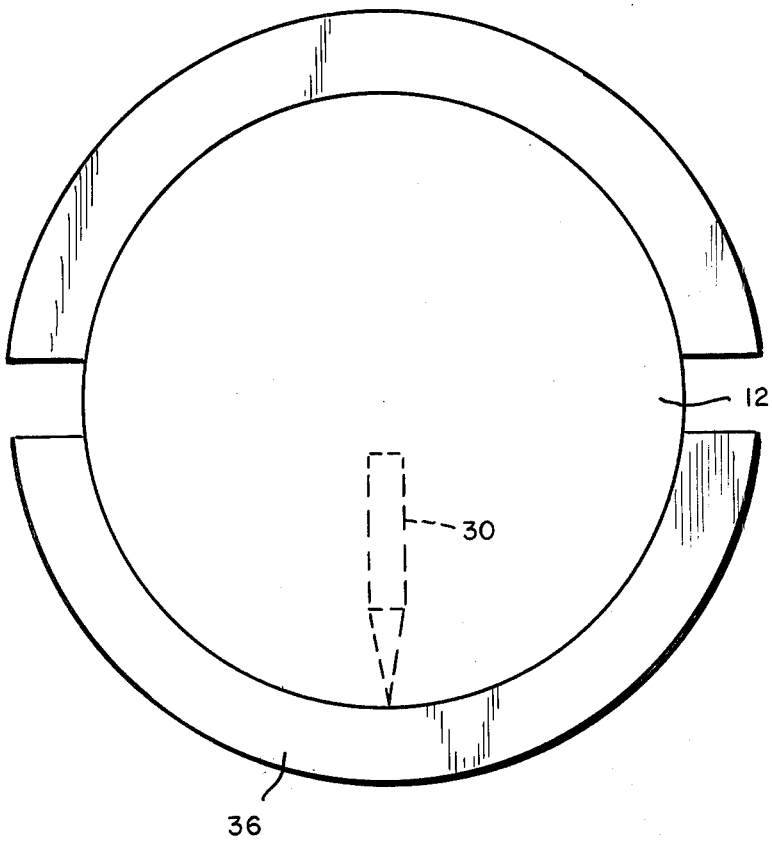
FIG. 18 is a section like that shown in FIG. 16 showing a ring gage for setting the needles flush with one of the surfaces of the picker.

In accordance with this invention a mechanical assist is used for supplementing the action of the vacuum in such a way as to increase the frictional resistance to the slippage of the label on the picker surface without penetration or otherwise damaging, fraying, pricking, tearing or scratching the surfaces of the labels. This is achieved as shown in FIGS. 16, 17 and 18 by mounting within the vacuum slots needles 30, one in each of the sots. A hole 32 is drilled within each slot 22 so that it extends thru to one of the passages 24. The slots are ⅛ to 5/32 inch wide and the holes which are 0.0595 inches in diameter are drilled as shown in FIG. 17 between one end of the slots and the passages 24. The needles are set into the holes with their pointed ends 34 substantially flush with the arcuate surfaces of the picker and fixed therein by suitable means. The needles are steel of the kind which have been used for many years on old style Victrola records. A ring gage 36, FIG. 18, is employed to position the pointed ends of the needles at the surfaces.

As thus fixed in the vacuum slots when the end of a label L, FIG. 16, is pulled into engagement with the annular surfaces of the picker across the slots 22 it is brought into engagement with the pointed ends of the needles without penetrating or puncturing the surface of the label or even scratching it but sufficiently to lightly engage the surface and thus increase the friction between the label and the picker sufficiently to prevent any possible slippage caused by the slickness of the surface finish of the label. As shown in FIG. 15, there are three pairs of longitudinally spaced slots disposed diametrically, each of which contains a needle so that a good grip is assured without any of the disadvantages inherent in the pin type feeding apparatus conventionally employed for feeding sheet material wherein the pins actually puncture the sheet material.

The combination vacuum and needle picking operation afforded by the structure described above enables, as pointed out heretofore, picking labels comprised of hard papers and/or papers having a high surface gloss and so solves a problem which has constituted a nuisance in the past, to wit, loss of operating time due to the failure of the vacuum pcking apparatus without the mechanical picking aid illustrated herein falling to properly feed labels all the time. A picker provided with a vacuum pump of 1 to 3 horsepower in combination with the mechanical assist in the form of one or two needles per vacuum orifice is capable of picking most any label which will be encountered.

The use of the combination vacuum and mechanical picking as illustrated herein is shown in combination with labeling apparatus wherein the label is removed from the end of the stack of labels by rotating the picker in a direction opposite to the direction of withdrawal of the label from the magazine so as to bend the label upwardly upon itself and then by carrying it further upwardly between a fixed guide and a feed roll and releasing it causing the label to straighten out by its own inherent elasticity. It is within the scope of this invention, however, to remove labels from the ends of a stack of labels by rotating the picker in the opposite direction, that is, in a direction to withdraw the label from the stack of labels in the plane of the end face of the stack of labels and for the reasons given above the combination will act to insure a better grip on the surface of the label as it is withdrawn from the stack, hence, the invention as herein disclosed and described is considered to include the combination of vacuum and mechanical picking of labels which have extremely smooth and slippery surfaces by means of a rotary picker without slippage of the labels relative to the surface of the picker and to achieve this without puncturing, tearing, fraying or otherwise damaging the surface of the label independently of the direction of rotation of the picker.

The use of the needles such as shown in FIGS. 16, 17 and 18 is convenient because they are readily available commercial items which are inexpensive, durable and easy to install in the picker without special machining operations. It is within the scope of the invention, when necessary, to provide two needles in each slot one at each end.

It should be understood that the present invention is for the purpose of illustration only and includes all modifications or improvements which fall within the scope of the appended claims.

I claim:

1. Apparatus for removing labels from a stack of labels comprising a rotatable picker member having a plurality of unyielding cylindrical vacuum picking surfaces concentric with the axis of rotation of said picker member, means supporting the picker member for rotation with its axis parallel to the plane of the endmost label of the stack of labels and at such a distance therefrom that the picking surfaces have tangential engagement with the endmost label, slots in the vacuum picking surfaces of the picker member, means for rotating the picker member to periodically bring the slots into engagement with the endmost label, means for connecting the slots at the place of tangency to a vacuum to grip and hold the label at a predetermined place in its rotation and beyond the place of tangency of disconnect them from the vacuum to release the label, and pins fixed at one end within the slots with their opposite ends substantially flush with the vacuum picking surfaces of the picker member with which the label is drawn into engagement by the vacuum to resist movement of the label relative to the picker member.

* * * * *